US011673068B2

(12) United States Patent
Lim et al.

(10) Patent No.: US 11,673,068 B2
(45) Date of Patent: Jun. 13, 2023

(54) DISPOSABLE BALLOON HOLDER AND METHOD OF USING

(71) Applicant: PARTYDRAGON LIMITED, Hong Kong (CN)

(72) Inventors: Wong Sum Lim, Tsing Yi (HK); Lai Sin Yi, Kowloon (HK); Miu Wong, Hong Kong (HK)

(73) Assignee: PARTYDRAGON, LIMITED, Hong Kong (CN)

( * ) Notice: Subject to any disclaimer, the term of this patent is extended or adjusted under 35 U.S.C. 154(b) by 0 days.

(21) Appl. No.: 16/987,724

(22) Filed: Aug. 7, 2020

(65) Prior Publication Data

US 2021/0039004 A1 Feb. 11, 2021

Related U.S. Application Data

(60) Provisional application No. 62/891,176, filed on Aug. 23, 2019, provisional application No. 62/884,515, filed on Aug. 8, 2019.

(51) Int. Cl.
*A63H 27/10* (2006.01)

(52) U.S. Cl.
CPC ..... *A63H 27/10* (2013.01); *A63H 2027/1041* (2013.01)

(58) Field of Classification Search
CPC ..... A63H 27/10; A63H 2027/1041; A63H 2027/105
USPC ..... 446/220, 222
See application file for complete search history.

(56) References Cited

U.S. PATENT DOCUMENTS

| | | | | | |
|---|---|---|---|---|---|
| 1,201,045 | A | * | 10/1916 | Head | A63H 27/10 446/222 |
| 1,680,318 | A | | 8/1928 | Callahan | |
| 2,396,906 | A | * | 3/1946 | Windson | A63H 27/10 446/222 |
| 3,094,807 | A | * | 6/1963 | Dorman | A63H 27/10 446/222 |
| 3,978,555 | A | * | 9/1976 | Weisenthal | A44B 11/14 24/543 |
| 4,380,103 | A | * | 4/1983 | McGrath | A44B 99/00 24/30.5 P |
| 4,416,038 | A | * | 11/1983 | Morrone, III | A44B 99/00 24/487 |
| 4,664,081 | A | | 4/1987 | Basseches | |

(Continued)

FOREIGN PATENT DOCUMENTS

| | | |
|---|---|---|
| CN | 103550920 | 2/2014 |
| EP | 0956889 | 3/1999 |

(Continued)

*Primary Examiner* — Joseph B Baldori
(74) *Attorney, Agent, or Firm* — Law Office of Gerard F. Dunne, PC; Gerard F. Dunne

(57) ABSTRACT

A holder for an inflatable balloon includes an elongate blank formed from cardboard or similar biodegradable yet resilient material that can be folded at its mid region and having an opening at a first end for receiving the inflation stem of an inflated balloon, and in one embodiment has at its other end portion a pressing element and slots formed in the end portions to be aligned when the elongate element is folded upon itself to pinch the stem of the inflated balloon. In another embodiment, a receptacle is provided by engaging tabs and slots at the respective end portions.

12 Claims, 2 Drawing Sheets

(56) References Cited

U.S. PATENT DOCUMENTS

| | | | | |
|---|---|---|---|---|
| 4,694,554 | A * | 9/1987 | McGrath | A63H 27/10 29/235 |
| 5,021,022 | A | 6/1991 | Ganz | |
| 5,203,530 | A | 4/1993 | Liu | |
| 5,301,392 | A | 4/1994 | Richman | |
| 5,411,427 | A * | 5/1995 | Nelson | A63H 27/10 24/30.5 P |
| 5,799,377 | A * | 9/1998 | Carroll | A63H 27/10 24/30.5 R |
| 6,375,534 | B1 | 4/2002 | Burns | |
| 7,249,991 | B1 | 7/2007 | Watson | |
| 7,322,073 | B2 * | 1/2008 | Cuisinier | A44B 99/00 24/30.5 S |
| 9,011,195 | B2 | 4/2015 | Sidwell | |
| 2002/0155780 | A1 | 10/2002 | Verner et al. | |
| 2004/0198146 | A1 | 10/2004 | Murray | |
| 2014/0338155 | A1 * | 11/2014 | DeNyse, Jr. | A63H 27/10 24/20 R |
| 2017/0319976 | A1 | 11/2017 | Nelson et al. | |
| 2020/0009467 | A1 | 1/2020 | Clephan et al. | |

FOREIGN PATENT DOCUMENTS

| | | | |
|---|---|---|---|
| GB | 2186905 | | 8/1987 |
| GB | 2272170 | A | 5/1994 |
| JP | S56-49179 | A | 5/1981 |
| JP | 2002 143571 | | 5/2002 |

* cited by examiner

DISPOSABLE BALLOON HOLDER AND METHOD OF USING

CROSS-REFERENCE TO RELATED APPLICATIONS

This application claims the benefit of priority to U.S. Provisional Application Ser. No. 62/884,515, filed on Aug. 8, 2019, and to U.S. Provisional Application Ser. No. 62/891,176, filed on Aug. 23, 2019. The disclosures, drawings and descriptions of each of these provisional applications are incorporated herein by this reference.

FIELD OF THE INVENTION

The present invention relates to various embodiments for a cardboard or paperboard blank that can be easily folded to form a holder for an inflated balloon while maintaining its inflated condition.

BACKGROUND OF THE INVENTION

Various attempts have been made to provide balloon holders, but many such holders are made from a synthetic plastics material which can provide disposal concerns, or those that are made of more environmentally favored cardboard to hold the filling stem of a balloon to provide a holder. Such cardboard devices are often difficult to manipulate, especially by children. The present invention provides an improved cardboard blank that can be folded in a rather simplified manner to hold the filling stem at the base of an inflated balloon to provide a stable device to hold the balloon.

Prior devices include those disclosed in United Kingdom patent application no. GB 2379619, which describes in FIG. 1 a clip that may be formed of cardboard to serve as a sealing member for gas-tight sealing of an inflated balloon. The clip includes an aperture 12 for receiving the neck of a balloon and a slot 14 for receiving the neck of an inflated balloon. This rather simple device does not include a device for holding the balloon in a secure manner by the user, which often may be a child.

United States published patent application US 2020/0009467 discloses a rather complicated blank that may be formed of a cardboard material that may seal a balloon and provide a holder; but is rather complicated to fold and secure; especially for children. Similarly, Japanese publication no. 2002143571 illustrates a balloon holder formed of paper that may hold and seal a balloon airtight; but, again, is rather complex.

It is, therefore, an object of the present invention to provide a balloon holder formed of a cardboard or paper material that may secure an inflated balloon securely to maintain the balloon in its inflated condition, and yet is simple in construction to enable a wide range of users, including children.

SUMMARY OF THE INVENTION

These and other objects, features and advantages of the present invention are provided by an elongate blank formed from cardboard or similar biodegradable yet resilient material that can be folded at its mid region to bring the two end portions together to provide a holder for an inflated balloon. In one embodiment, an opening is provided at a first end portion adapted for receiving the inflation stem of an inflated balloon, and at least one slot is adjacent the opening to receive and pinch tightly the stem of the inflated balloon. The elongate blank has at its other end portion a pressing element.

The elongate blank in the first embodiment can be folded upwardly upon itself to bring the pressing portion into alignment with the first end portion to press the balloon stem there between; and the pressing portion also has at least one slot to align with the at least one slot of the first end portion to also receive and pinch tightly the stem of the inflated balloon. The stem of the inflated balloon would be stretched to fit within the aligned slots to further grip the stem of the balloon between the first end portion and the pressing portion. Preferably, there would be two slots positioned on respective side portions of the opening in the first end portion to enable the stem of the inflated balloon to be wrapped tightly around the aligned first end portion and pressing end portion to more securely pinch the stem of the inflated balloon.

In this embodiment of the present invention, the stem of an inflated balloon can be pinched tightly enough so that the stem need not be tied into knot, which is often difficult, especially for children when the balloon has been inflated to a high degree. Further, the stem of the inflated balloon can be inserted within the opening and the elongate blank folder upwardly to engage the pressing portion against the filing stem in a very simple manner; and the stem of the balloon stretched to wrap around the end portions and fitted within the mating slots.

The device of this embodiment of the present invention is simple to operate; one need simply insert the stem of the inflated balloon into the opening in the first end portion; fold the device upwardly so the pressing portion engages the stem of the inflated balloon, and wrap the stem into the slots.

In another embodiment of the present invention, the first end portion of an elongate blank has an opening to receive the stem of an inflated balloon, and is configured with tabs to receive slots formed in the other end of the elongate blank to be folded from its mid region to form a receptacle to receive the end portion of an inflated balloon. In this second embodiment, the inflation stem of the balloon can be passed through the opening from the inside of the receptacle to be formed, and then tied in a knot sufficiently large so as to not be able to pass through the opening; and the blank can be folded upwardly to engage the tabs and slots to form the receptacle. In this way, unlike the first embodiment, a supportive receptacle for the portion of the balloon having the inflation stem can be provided; and yet the device is simple to manipulate.

These and other objects, advantages and features of the present invention will be apparent from the detailed descriptions made below with reference to the accompanying drawings, in which:

DETAILED DESCRIPTIONS OF PREFERRED EMBODIMENT

Figure 1:
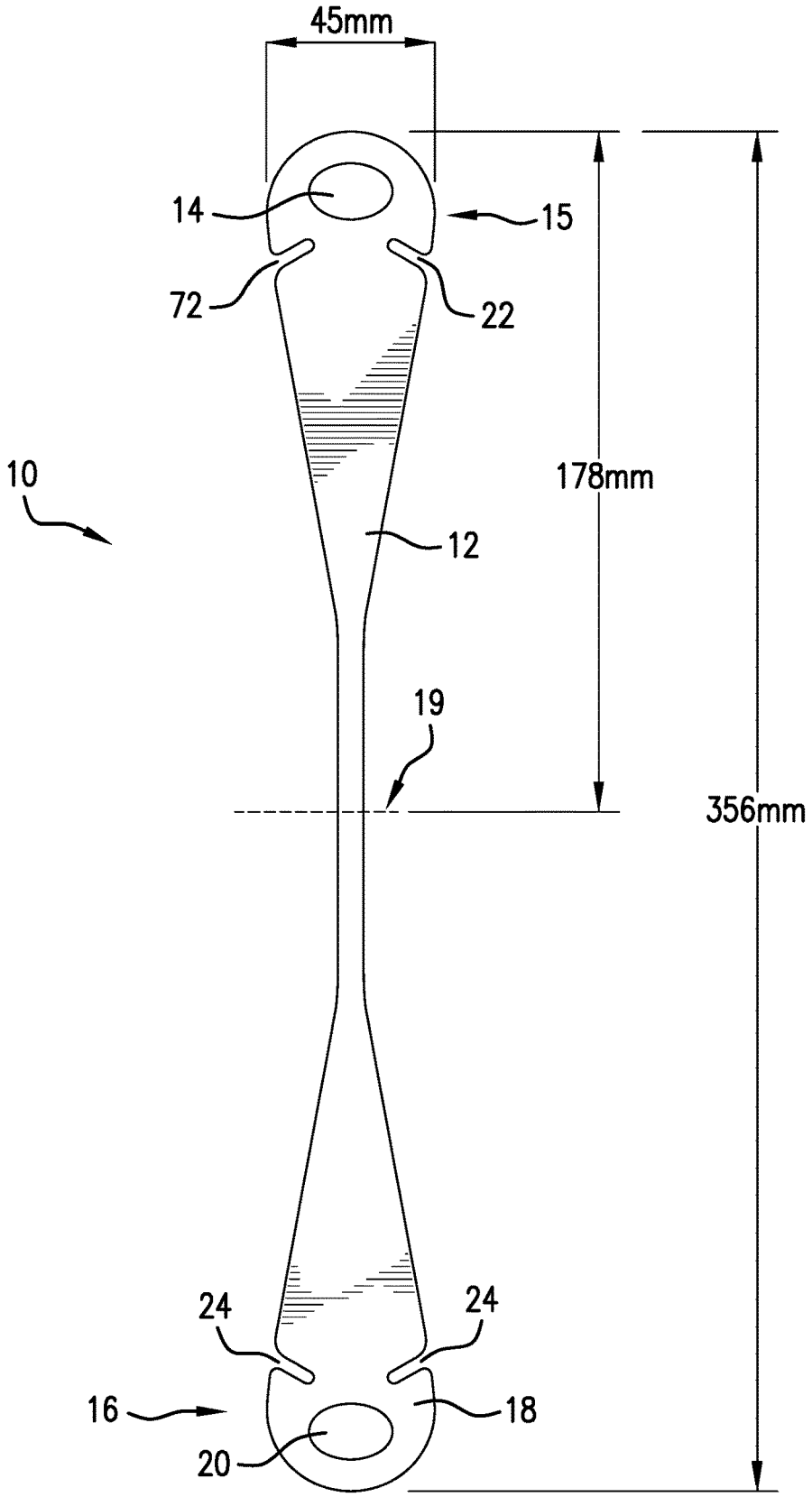
FIG. 1 illustrates the holder for an inflated balloon as it is stamped from a section of card or paperboard according to the first embodiment of the present invention.

The holder 10 of an embodiment of the present invention is shown in FIG. 1 with its preferred dimensions; and is preferably stamped from a 200 gram (GSM) or heavier, paper/kraft paper/cardboard material. Such material is biodegradable and thus environmentally favored as it can be disposed without the plastic waste associated with plastic balloon holders.

The holder 10 is formed as an elongate blank 12 that narrows towards its mid region and has an opening 14 at a first end portion 15. The elongate blank 12 has at its other end portion 16 a pressing element 18 which may also have an opening 20. The stem of an inflated balloon can be inserted through the opening 14 and the elongate blank 12 can be folded upwardly along fold line 19 to bring the pressing element 18 into alignment with the first end portion 15 to press the balloon stem between first end portion 15 and pressing portion 18.

The first end portion 15 and the pressing element 18 each have respective slots 22 and 24 that can be aligned when the elongate blank is folded. The balloon stem can thus be held between the first end portion 15 and the pressing element 18, and the balloon stem stretched and wrapped into the slots 22 and 24 forcibly to press the balloon stem between first end portion 15 and the pressing element 18. In the way, the balloon stem can be held securely.

In this embodiment of the present invention, the stem of an inflated balloon can be pinched tightly enough so that the stem need not be tied into knot.

Figure 2:
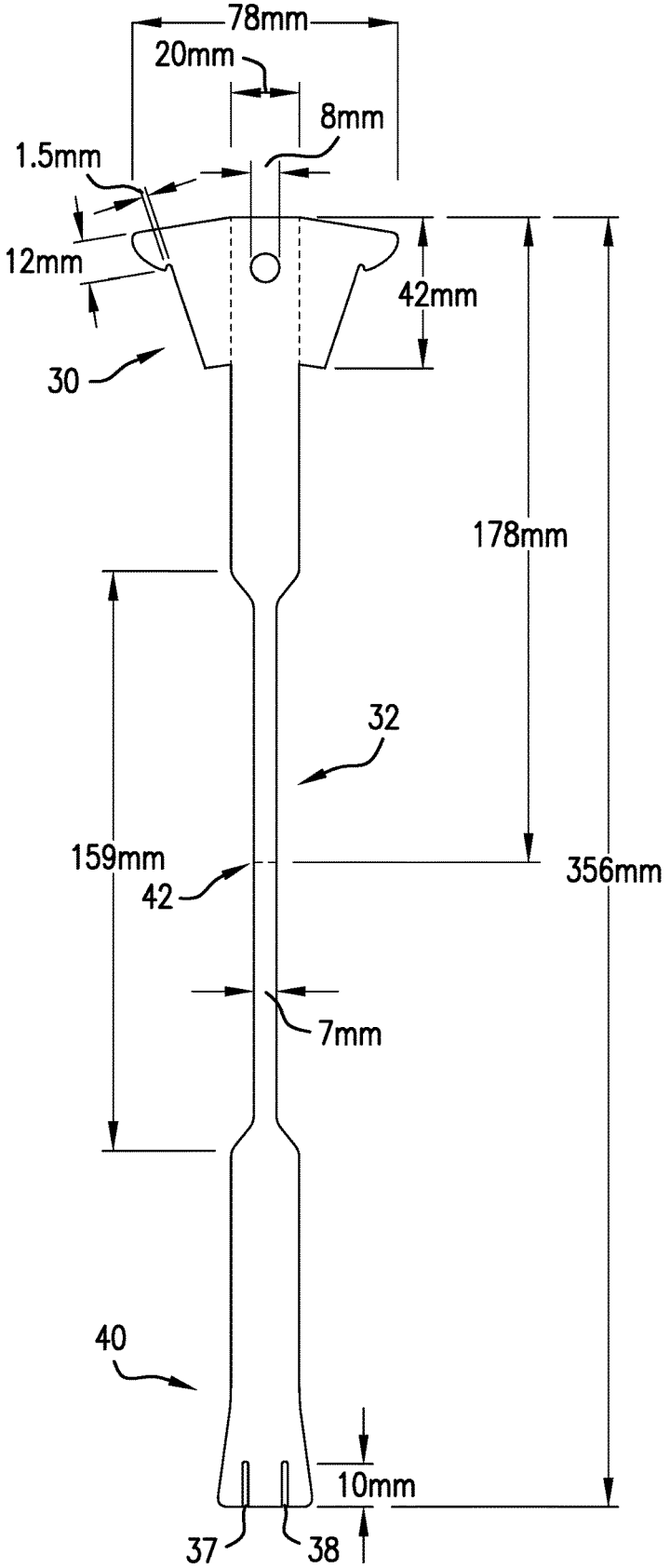
FIG. 2 illustrates the front side of a holder for an inflated balloon as it is stamped from a section of card or paperboard according to the second embodiment of the present invention.
Figure 3:
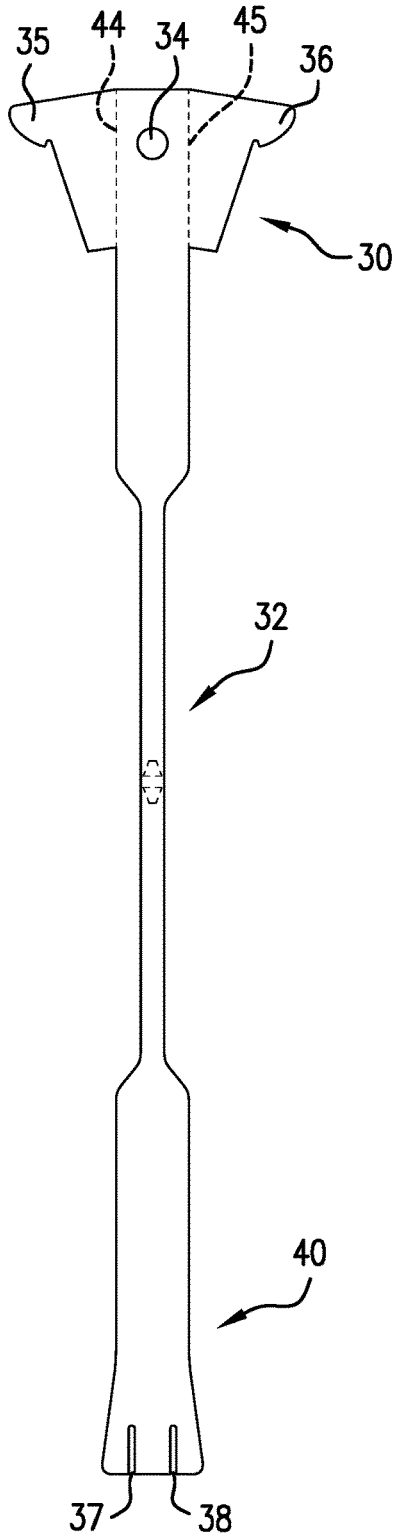
FIG. 3 illustrates the rear side of a holder for an inflated balloon as it is stamped from a section of card or paperboard according to the second embodiment of the present invention.

In another embodiment of the present invention shown in FIGS. 2 and 3, the first end portion 30 of an elongate blank 32 has an opening 34 to receive the stem of an inflated balloon, and is configured with tabs 35 and 36 to receive slots 37 and 38 formed in the other end 40 of the elongate blank 32. The filling stem of an inflated balloon can be inserted through the one side of the opening 34 and the outer end tied into a knot. The opening 34 is sized to be smaller in diameter than the knot tied in the filling stem.

The blank 32 can be folded upwardly along fold line 42 in its mid region to bring the other end 40 towards the balloon stem extending through opening 34, and the fold lines 44 and 45 of the first end portion can be folded to approximately right angles to enable the tabs 35 and 36 to be inserted into the slots 37 and 38 to form a receptacle; with the knot of the balloon stem extending outside the receptacle.

The receptacle thus formed is able to receive the end portion of an inflated balloon. In this second embodiment, the inflation stem is passed through the opening 34 from what would be the inside of the receptacle to be formed. In this way, unlike the first embodiment, a supportive receptacle for the portion of the balloon having the inflation stem can be provided.

What is claimed is:

1. A holder for an inflatable balloon, comprising an elongate blank formed from biodegradable material and having a mid region located centrally within said elongate blank, and end regions of said elongate blank extending oppositely from said mid region to respective first and second end portions located at opposite extremities of said elongate blank, an opening in said first end portion located at one extremity of said elongated blank, said opening being adapted for receiving the inflation stem of an inflated balloon there through, said mid region of said elongate blank being foldable along a line to enable the elongate blank to be folded at said mid region to bring said first end portion and said second end portion towards one another in position to engage an inflated balloon, said mid region thereby being adapted to be folded upon itself to form a handle able to be grasped for holding an inflated balloon.

2. The holder for an inflatable balloon as set forth in claim 1, including at least one slot adjacent said opening to receive and pinch a portion of the stem of an inflated balloon, said second end portion of said elongate blank configured to align with said first end portion when said elongate blank is folded upon itself to align with said first end portion.

3. The holder for an inflatable balloon as set forth in claim 2, including an opening in said second end portion of said elongated blank, said second end portion of said elongated blank having a slot adjacent said opening in said second end portion of said elongated blank.

4. The holder for an inflatable balloon as set forth in claim 3, said elongate blank being folded upon itself to bring said second end portion into alignment with said first end portion into a configuration serving to hold the balloon stem there between with said slots in alignment to receive and pinch the stem of the inflated balloon whereby the stem of the inflated balloon could be stretched to fit within the aligned slots to further grip the stem of the balloon between said first end portion and said second end portion.

5. The holder for an inflatable balloon as set forth in claim 4, further including an additional slot to provide two slots positioned on respective side portions of the opening in said first end portion and said second end portion to enable the stem of the inflated balloon to be wrapped around the aligned first end portion and said second end portion to more securely pinch the stem of the inflated balloon.

6. The holder for an inflatable balloon as set forth in claim 2, further including an additional slot to provide two slots positioned on respective side portions of the opening in said first end portion and said second end portion to enable the stem of the inflated balloon to be wrapped around the aligned first end portion and said second end portion to more securely pinch the stem of the inflated balloon.

7. The holder for an inflatable balloon as set forth in claim 1, said first end portion and said second end portions having mating tabs and slots to enable a receptacle to be formed for holding the inflated balloon as the elongate member is folded along its mid region to bring said first and second end portions into engagement.

8. A holder for receiving an inflatable balloon, comprising an elongate blank formed from biodegradable material and having a mid region located centrally within said elongate blank, and end regions of said elongate blank extending oppositely from said mid region to a first end portion and a second end portion located respectively at opposite extremities of said elongate blank, an opening located within said first end portion, said opening being adapted for receiving the inflation stem of an inflated balloon, and at least one slot located within said first end portion and adjacent said opening to receive and pinch the stem of the inflated balloon, said second end portion of said elongate blank configured to align with said first end portion when said elongate blank is folded upon itself at said mid region to bring said second end portion into alignment with the first end portion to be able to hold an inflated balloon, said mid region thereby being adapted to be folded upon itself to form a handle able to be grasped for holding an inflated balloon.

9. The holder for receiving an inflatable balloon as set forth in claim 8, said elongate blank being folded upon itself at said mid region to bring said second end portion into alignment with the first end portion into a configuration to hold the balloon there between; said second end portion having at least one slot to align with said at least one slot of the first end portion to receive the stem of the inflated balloon whereby the stem of the inflated balloon would be stretched to fit within the aligned slots to further grip the stem of the balloon between said first end portion and said second end portion.

10. The holder for receiving an inflatable balloon as set forth in claim 9, further including an additional slot to provide two slots positioned on respective side portions of the opening in said first end portion to enable the stem of the inflated balloon to be wrapped around the aligned first end portion and said second end portion to pinch the stem of the inflated balloon.

11. The holder for receiving the inflation stem of an inflatable balloon as set forth in claim 10, including an opening in said second end portion of said elongated blank, said second end portion of said elongated blank having a slot adjacent said opening in said second end portion of said elongated blank.

12. A method of providing a holder for an inflatable balloon, said holder formed from an elongate blank of biodegradable material, said holder having a mid region located centrally within said elongate blank, and end regions of said elongate blank extending oppositely from said mid region to end portions at opposite extremities of said elongate blank, including inserting the end region of the inflation stem of an inflatable balloon into an opening in a first end portion of an elongate blank and folding the elongate blank upon itself along a mid region of the elongate blank to form a handle from said mid region able to be grasped for holding an inflated balloon and bring the end portions at opposite extremities of said elongate blank together to hold an inflated balloon.

* * * * *